US008919010B2

(12) United States Patent
Doh

(10) Patent No.: US 8,919,010 B2
(45) Date of Patent: Dec. 30, 2014

(54) DRYER AND METHOD FOR CONTROLLING OF THE SAME

(75) Inventor: Young Jin Doh, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1673 days.

(21) Appl. No.: 12/297,183

(22) PCT Filed: Apr. 13, 2007

(86) PCT No.: PCT/KR2007/001802

§ 371 (c)(1),
(2), (4) Date: Jun. 19, 2009

(87) PCT Pub. No.: WO2007/119974

PCT Pub. Date: Oct. 25, 2007

(65) Prior Publication Data

US 2010/0011614 A1 Jan. 21, 2010

(30) Foreign Application Priority Data

Apr. 14, 2006 (KR) ..... 10-2006-0034063

(51) Int. Cl.
*D06F 58/28* (2006.01)
*F26B 25/22* (2006.01)

(52) U.S. Cl.
CPC ..... *D06F 58/28* (2013.01); *D06F 2058/2809* (2013.01); *D06F 2058/2838* (2013.01); *D06F 2058/289* (2013.01)
USPC ..... 34/550; 34/495

(58) Field of Classification Search
CPC ..... D06F 58/28; D06F 2058/289; D06F 2058/2809; D06F 2058/2838; D06F 2058/2835; D06F 2058/2861; D06F 2058/2816
USPC ..... 34/493, 491, 494, 495, 528, 535, 536, 34/550, 132
See application file for complete search history.

(56) References Cited

U.S. PATENT DOCUMENTS 3,394,467 A * 7/1968 Janke ..... 34/532
3,409,994 A * 11/1968 Menk ..... 34/499
3,702,030 A * 11/1972 Janke ..... 34/498
4,385,452 A * 5/1983 Deschaaf et al. ..... 34/562

(Continued)

FOREIGN PATENT DOCUMENTS

CN 1724798 A 1/2006
KR 1996-0013395 B1 10/1996
KR 2004/0050448 A 6/2004

*Primary Examiner* — Kenneth Rinehart
*Assistant Examiner* — Tavia Sullens
(74) *Attorney, Agent, or Firm* — Birch, Stewart, Kolasch & Birch, LLP

(57) ABSTRACT

The present invention relates to a dryer which can sense a laundry amount and a dryness, and a method for controlling the same. The dryer includes a drum (3) for holding a drying object, a heater (5*a*, 5*b*) for supplying hot air to an inside of the drum (3), a sensing unit (20) for providing a pulse signal depending an contact to the drying object in the drum (3), a microcomputer (60) for determining a load and dryness of the drying object with reference to the pulse signal from the sensing unit (20) to control a general drying course. According to this by providing a new system of sensing means in which the load and the dryness can be determined, not by using a direct contact system with the electrode sensor, but by using a number of contact to the laundry, the present invention permits to provide more accurate and safer system.

12 Claims, 4 Drawing Sheets

(56) References Cited

U.S. PATENT DOCUMENTS

| | | | | | |
|---|---|---|---|---|---|
| 4,531,305 | A * | 7/1985 | Nagayasu et al. | 34/445 |
| 4,738,034 | A * | 4/1988 | Muramatsu et al. | 34/524 |
| 5,172,490 | A * | 12/1992 | Tatsumi et al. | 34/488 |
| 5,347,727 | A * | 9/1994 | Kim | 34/491 |
| 5,570,520 | A | 11/1996 | Huffington | |
| 6,446,357 | B2 * | 9/2002 | Woerdehoff et al. | 34/491 |
| 6,928,749 | B2 * | 8/2005 | Park | 34/491 |
| 7,020,982 | B2 * | 4/2006 | Park et al. | 34/496 |
| 2004/0055176 | A1 * | 3/2004 | Yang et al. | 34/549 |
| 2004/0168343 | A1 | 9/2004 | Park | |
| 2004/0200093 | A1 * | 10/2004 | Wunderlin et al. | 34/606 |
| 2005/0252028 | A1 * | 11/2005 | Park et al. | 34/528 |
| 2006/0242858 | A1 * | 11/2006 | Beaulac | 34/446 |
| 2009/0049709 | A1 * | 2/2009 | Doh | 34/524 |
| 2010/0064546 | A1 * | 3/2010 | Doh et al. | 34/572 |

* cited by examiner

DRYER AND METHOD FOR CONTROLLING OF THE SAME

TECHNICAL FIELD

The present invention relates to a dryer which can sense a laundry amount and a dryness, and a method for controlling the same.

BACKGROUND ART

In general, in the laundry dryer for automatic drying of wet washed laundry, there are exhaust type laundry dryers and condensing type laundry dryers.

Of the laundry dryers, the exhaust type dryers will be described.

FIG. 1 illustrates a diagram of a related art exhaust type dryer, and FIG. 2 illustrates a diagram of a flow passage of the dryer in FIG. 1.

The related art laundry dryer is provided with a body 1 having a door 2 in a front, a drum 3 rotatably mounted in the body 1 having a plurality of lifters 4 projected from an inside circumferential surface, driving means for providing rotating force to the drum 3, a heater 5 for heating external air introduced thereto to a high temperature, to produce a hot air, a suction duct 7 in communication with a rear opening of the drum 3 for guiding the hot air from the heater 5 to an inside of the drum 3, a lint duct 8 in communication with a front opening of the drum 3, for guiding humid air discharged after drying to an exhaust duct 15, and a fan 13 in rear of the lint duct 8 for generating blowing force.

Mounted to an inlet to the lint duct 8, there is a filter 14 for filtering foreign matter, such as lint, from air discharged from the drum 3.

The driving means for rotating the drum 3 is provided with a motor 10, and a driving belt 12 connected to a pulley 11 coupled to the motor 10 and wound around an outside circumferential surface of the drum 3, for rotating the drum 3 as the belt 12 wound on the driving pulley 11 rotates following rotation of the driving pulley by rotation of the motor 10.

Mounted to a front portion of the drum 3, there is an electrode sensor 30 for detecting a dryness of a drying object. The electrode sensor 30 has two metal plates arranged in parallel to each other, so that the electrode sensor 30 senses the dryness of the laundry with reference to an impedance generated at the opposite electrodes according to a water content of the drying object when the drying object is in contact with the opposite metal plates at the same time, and provides the dryness in a voltage signal.

That is, a microprocessor (so called micom) (not shown) which controls a general dryer system receives a the voltage signal from the electrode sensor 30, determines the dryness of the drying object with reference to a voltage level, and controls operation of the dryer according to this.

However, the direct contact type measurement of the dryness with the electrode sensor 30 fails to measure an accurate dryness due to a great deviation of the impedance coming from differences of impedances of various amounts of the drying objects, water contents, and kinds of the drying objects.

Moreover, an accurate sensor and a detecting circuit are required because, though the measurement of the dryness is easy owing to a great difference of the impedances varied at the time of initial drying when the drying object has much water content, the difference of the voltages provided is very small as the drying is progressed.

Moreover, the related art dryer, which finishes a course in a case a dryness sensed at the electrode sensor 30 reaches to a target dryness, fails to provide separate means for determining the amount of laundry.

That is, since the heater 5 is operated in a full capacity regardless of a load of the drying object, to provide hot air, energy more than necessary has been consumed in a drying course for a small load.

In a case an inverter control system is employed in which a speed of the motor 10 is varied freely, a sensing circuit including the electrode sensor 30, not only uses a power source the same with an inverter circuit, but also grounded to a ground terminal the same with the inverter circuit.

In this instance, since the inverter circuit is operated with utility AC power, and the sensing circuit is connected to the ground terminal the same with the inverter circuit without the power source being separated from each other, the sensing circuit has a high voltage applied thereto as it is.

That is, if a user opens the door and places a hand in the drum in a state the power source is not separated it is liable that an electric shock happens through the electrode sensor 30 and the laundry in contact with the electrode sensor 30.

DISCLOSURE OF INVENTION

Technical Problem

The present invention provides a dryer which can provide a new system of sensing means for sensing a load and a dryness of a drying object and a safer system.

The present invention provides a method for controlling a drying course taking a load of a drying object into account.

The present invention provides a dryer and a method for controlling the same, which can determine a load and a dryness of a drying object more accurately and more safely, for improving a drying performance.

Technical Solution

According to the present invention, as embodied and broadly described therein, a dryer includes a drum for holding a drying object, a heater for supplying hot air to an inside of the drum, a sensing unit for providing a pulse signal depending on contact to the drying object in the drum, and a microcomputer for determining a load and dryness of the drying object with reference to the pulse signal from the sensing unit to control a general drying course.

Preferably, the microcomputer counts a number of pulses per unit time period from the sensing unit, to determine the load and the dryness according to a counted value, and controls an output capacity of the heater and a drying course finishing point according to the load and the dryness determined thus.

Preferably, the heater includes a first heater and a second heater having output capacities different from each other. In this instance, preferably, the microcomputer controls operation of the first and second heaters according to the load of the drying object, selectively.

The sensing unit may include an electrode sensor for providing a voltage signal corresponding to impedance generated at a time the electrode sensor is brought into contact to the drying object, a comparator for comparing the voltage signal from the electrode sensor to a preset reference voltage, and providing a result of the comparison, and a photo-coupler for providing a pulse signal in response to a signal from the comparator.

In another aspect of the present invention, a method for controlling a dryer having first, and second heaters, and a sensing unit for sensing contact of a drying object thereto to provide a pulse signal, includes a load determining step of determining a load of the drying object with reference to a number of pulses from the sensing unit as an initial stage of a drying course, and a drying course step of driving the first, and second heaters selectively according to the load of the drying object determined thus, to perform the drying course.

The load determining step may include the steps of counting a number of pulses from the sensing unit per unit time period in a state operation of the heater is stopped for a predetermined time period and calculating an average of numbers of pulses per unit time period if the predetermined time period is passed to determine the load. Preferably, the step of calculating an average to determine the load includes the step of determining as a 'small load', if the average is below a preset value that is defined as the small load.

Preferably, the drying course step includes the step of operating one of the first, and second heaters selectively if the load determined thus is the 'small load', to perform the drying course.

In the meantime, the method may further include a dryness determining step of determining a drying finishing time point depending on reach of a number of the pulses from the sensing unit to the preset value during the drying course is performed.

The dryness determining step may include the steps of counting a number of pulses per unit time period from the sensing unit during the heater is operated and finishing entire course if a number of pulses per unit time period counted thus reaches to the preset value, determining that it is the drying finish time point.

BEST MODE FOR CARRYING OUT THE INVENTION

Reference will now be made in detail to the preferred embodiments of the present invention, examples of which are illustrated in the accompanying drawings.

In the meantime, though the exhaust type dryer is described as one embodiment of the present invention, aspects of the present invention are also applicable to the condensing type dryer.

Figure 1:
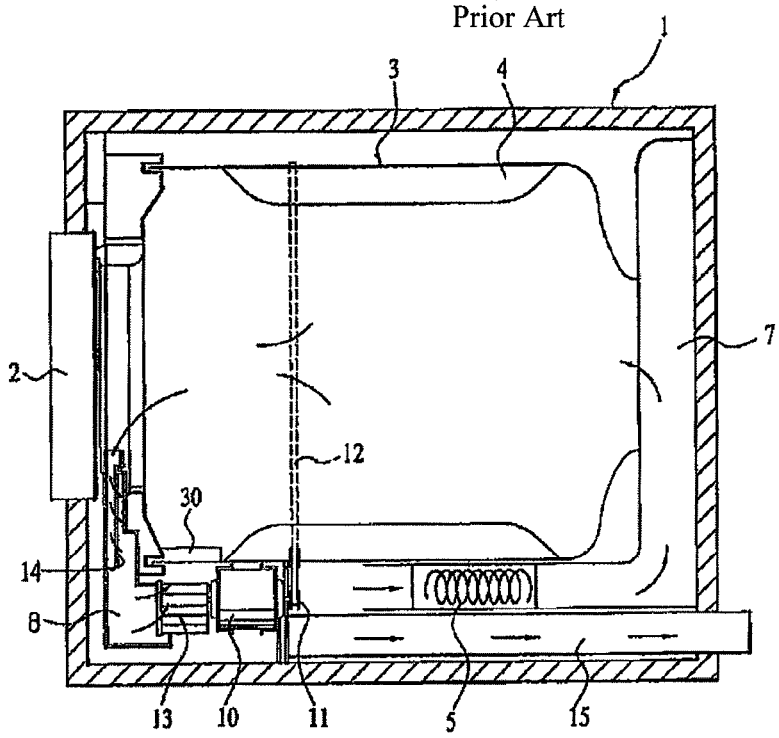
Fig. 1 Prior Art
FIG. 1 illustrates a longitudinal section showing an exemplary structure of a related art exhaust type laundry dryer.
Figure 2:
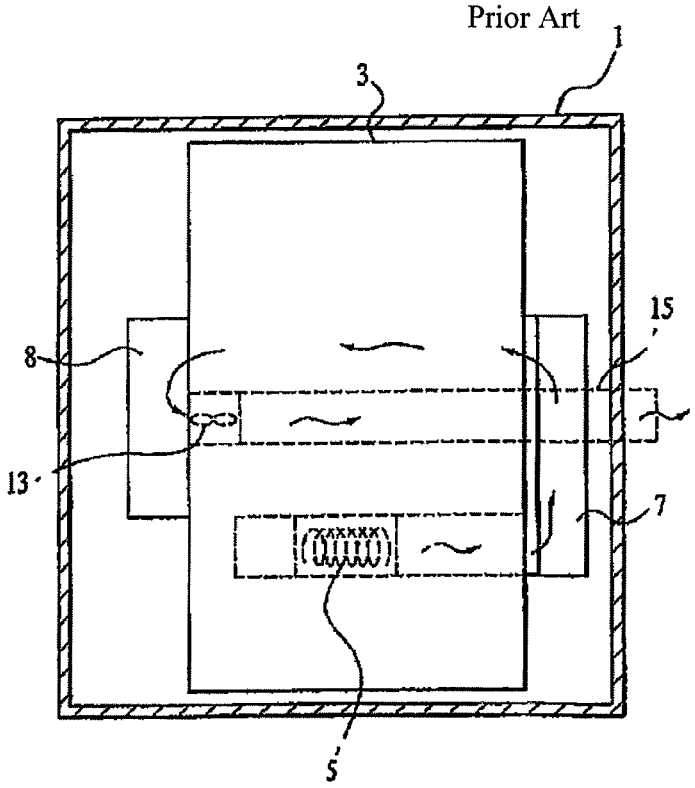
Fig. 2 Prior Art
FIG. 2 illustrates a section of key parts of the exhaust type laundry dryer in FIG. 1.
Figure 3:
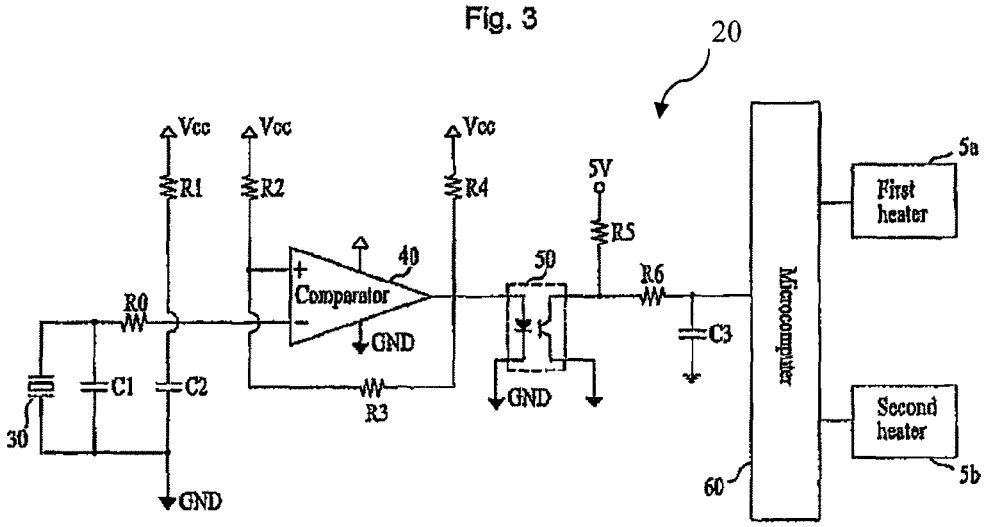
FIG. 3 illustrates a diagram of a dryer in accordance with a preferred embodiment of the present invention.

A load and dryness sensing unit in a dryer of the present invention will be described with reference to FIG. 3. Wherever possible, parts identical to the related art will be given reference numerals the same with FIG. 1.

As shown, the dryer includes a rotatably mounted drum 3 for holding a drying object, a heater 5*a* and 5*b* for supplying hot air to the drum 3, a sensing unit 20 for providing a pulse signal depending on contact to a drying object in the drum 3, and a microcomputer 60 for determining a load and dryness of the drying object with reference to the pulse signal from the sensing unit 20 to control a drying course in general.

The heater 5 is mounted in a suction duct 7 for heating air introduced thereto from an outside of the dryer and supplying the air to the drum 3, preferably including a first heater 5*a* having a high power (2500 W) heating coil, and a low power (750 W) heating coil. In this instance, it is preferable that the microcomputer controls operation of the first heater and the second heater selectively depending on the load of the drying object.

Preferably, the sensing unit 20 includes an electrode sensor 30 for providing a voltage signal corresponding to impedance generated at a time the electrode sensor is brought into contact to the drying object, a comparator 40 for comparing the voltage signal from the electrode sensor 30 to a preset reference voltage, and providing a result of the comparison, and a photo-coupler 50 for providing a pulse signal in response to a signal from the comparator 40.

In a connection system of the sensing unit 20, the electrode sensor 30 has a output terminal connected to an inverting terminal (−) of the comparator 40, and a reference voltage preset according to voltage dividing resistances R2 and R3 is connected to a non-inverting terminal (+) of the comparator 40. Along with this, it is preferable that an output terminal of the comparator 40 is connected to a light emission unit (i.e., an LED) of the photo-coupler 50, and a light receiving unit (i.e., a photo-transistor) of the photo-coupler 50 is connected to an input port of the microcomputer 60.

In this instance, it is preferable that the reference voltage of the comparator 40 is set below a voltage level on opposite ends of the electrode when a fully dried laundry is brought into contact with the electrode sensor 30. That is, if the laundry is dried fully, since a voltage signal higher than the reference voltage is generated even if the laundry is brought into contact to the electrode sensor 30, no pulse signal is provided to the microcomputer 60.

The sensing unit 20 employs, not a direct contact system, but a number of contact of the drying object thereto in determining the load and dryness of the drying object.

Moreover, by not employing the direct contact system of the electrode sensor 30, the sensing unit 20 can employ a DC power source 5V and a ground terminal separate from a motor driving circuit of the inverter and so on. Moreover, the photo-coupler 50 is used for electric insulation between the electrode sensor 30 and the microcomputer 60.

In detail, if the drying object is brought into contact with the electrode sensor 30 as the drum 3 rotates, the voltage signal corresponding to the impedance generated at both ends of the electrode of the electrode sensor 30 is generated and provided to the inverting terminal (−) of the comparator 40.

The comparator 40 compares the voltage signal at the electrode sensor 30 to the reference voltage to the noninverting terminal (+), to provide a high signal if the voltage signal is lower than the reference voltage. The photo-coupler 50 at the light emission unit emits a light in response to the high signal from the comparator 40, and the photo-transistor which is the light receiving unit is turned on in response to the light emitted thus, to provide the pulse signal to the microcomputer 60.

That is, whenever the electrode sensor 30 and the drying object are brought into contact to each other once, one pulse signal is generated. However, if a voltage signal higher than the reference voltage is generated no pulse signal is generated even if the electrode sensor 30 and the drying object are brought into contact to each other.

The microcomputer 60 counts a number of the pulse signals from the photo-coupler 50 per unit time period (for an example, one minute), and determines the load and dryness of the drying object with reference to the number of pulses per unit time period (a number of pulses/one minute).

Figure 4:
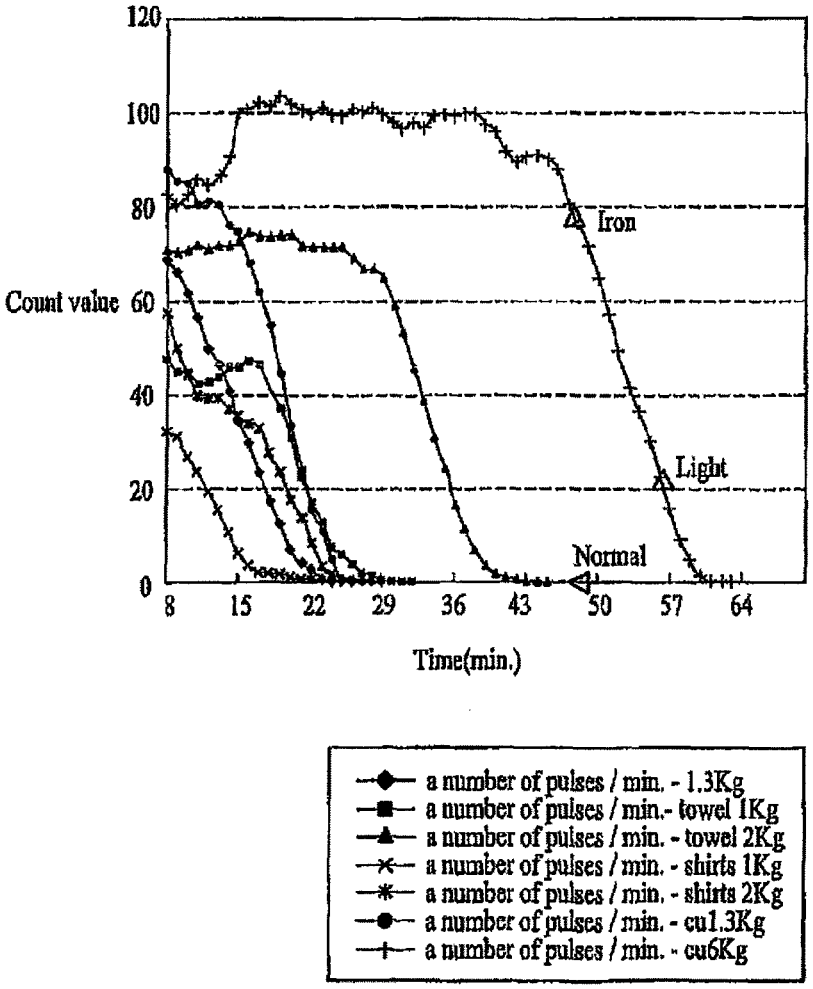
FIG. 4 illustrates a graph showing a number of contact to a drying object versus time.

FIG. 4 illustrates a result of count of a number of pulses per unit time period for various kinds of laundry and amounts of laundry, which is a graph showing counted values of the pulse signals versus time period.

As shown, at an initial stage of a course, a number of pulses per unit time period caused by laundry contact is relatively great because most of the laundry is wet, and as the course is progressed a number of pulses per unit time period is reduced owing to increase of dried laundry.

Because a target dryness varies with kinds of course, such as iron, light, normal, and so on, a number of pulses per unit time period corresponding the target dryness is found out through repeated experiments for each kind of courses, presets and stores the values at the system. That is, in the course, if a number of pulses per unit time period caused by contact to the drying object reaches to the preset value, the microcomputer understand that it is a dry finishing time point.

For an example, if the target dryness is preset to zero (0) corresponding to a normal drying mode, the microcomputer determines that it is the drying finishing time point if a number of pulses reaches to zero (0) during the course.

Figure 5:
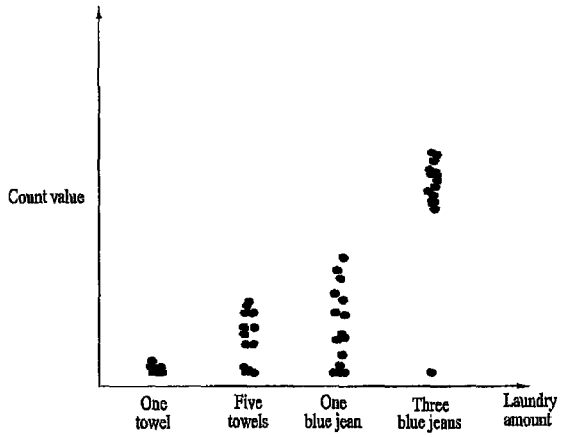
FIG. 5 illustrates a graph showing a number of contact to a drying object versus an amount of laundry.

In the meantime, FIG. 5 illustrates a result of count of a number of pulses per unit time period versus an amount of laundry, showing a number of the pulses per a unit time period from the sensing unit 20 obtained in repeated experiments for various loads.

As shown, it can be known that the smaller the amount of laundry, counted values of a number of pulses per unit time period from the sensing unit 20 are distributed in the vicinity of low levels of counted values the more.

After defining a weight of load intended to sense as a 'small' amount of load at first, an experiment is repeated in which a number of pulses per unit time period from the sensing unit 20 is counted for the drying object of the weight, and an average of numbers of pulses per unit time period obtained in the repeated experiments is calculated and stores in the system in advance. Then, at an initial stage of the course in using the product, if it is determined that a number of pulses per unit time period from the sensing unit 20 is below a number of pulses per unit time period stored in advance, the microcomputer understands it as a small load.

Figure 6:
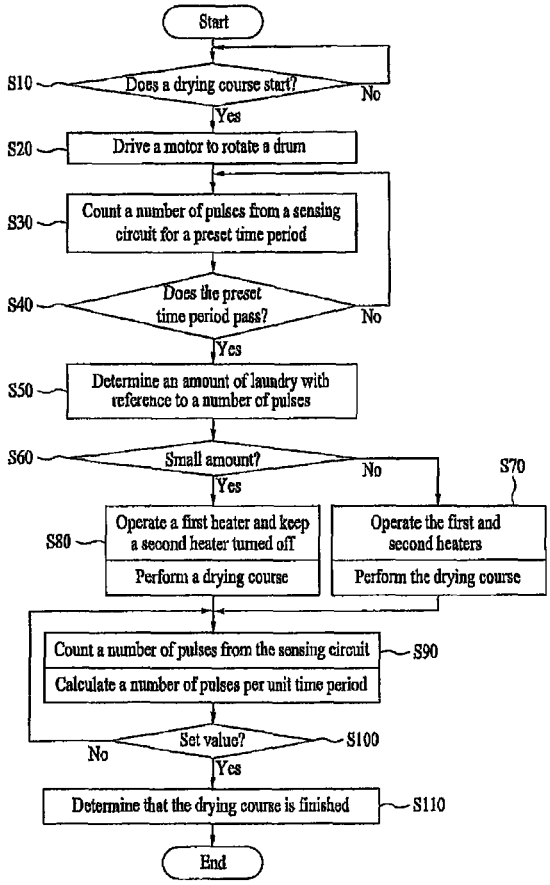
FIG. 6 illustrates a flow chart showing the steps of a method for controlling a dryer in accordance with a preferred embodiment of the present invention.

In the present invention having the load and dryness sensing unit 20, a method for sensing a load and dryness in a dryer and a method for controlling the same of the present invention will be described in detail with reference to FIG. 6.

When a user introduces wet drying object into the drum 3 and applying a course starting order to a dryer (S10), in order to determine the load of the drying object, the microcomputer only rotates the drum 3 for a preset time period in a state the heater 5*a* and 5*b* is not operated (S20).

In this instance, the microcomputer counts a number of pulses per unit time period from the sensing unit 20 for the preset time period and calculates an average of numbers of pulses per unit time period counted thus at a time point the preset time period is passed (S30).

Then, the microcomputer determines the load with reference to the average of numbers of pulses per unit time period calculated thus (S40, S50).

In the step of determining a load it is determined whether the average of the numbers of pulses per unit time period is sensed to be below the preset value defined as the small load (S60).

Since the load is not the small load if the average of the numbers of pulses per unit time period is higher than the preset value as a result of the determination (S60), the first and second heaters 5*a* and 5*b* are operated at the same time, to perform the drying (S70).

Since the load is the small load if the average of the numbers of pulses per unit time period is lower than the preset value as a result of the determination (S60), only the first heaters 5*a* is operated in a state the second heater 5*b* is turned off, to perform the drying (S80).

In the drying course of the step S70 or S80, the motor 10 is driven to drive the drum 3 and the fan 13, and external air drawn by the fan 13 is forcibly blow into the drum 3 under rotating through the suction duct 7 after heating the external air with the heaters 5*a* and 5*b*. In this instance, the hot air introduced into the drum 3 evaporates moisture from the wet drying object to dry the drying object, and is turned into low temperature, humid air, and discharged to an outside of the dryer through the lint duct 8 and the exhaust duct 15.

During the drying course is progressed while repeating above steps by driving the first, and second heaters 5*a* and 5*b* selectively, the microcomputer 60 receives the pulse signal from the sensing unit 20, and counts a number of pulses per unit time period (S90).

The microcomputer determines whether a number of pulses per unit time period counted thus reaches to the preset value defined already as a reference for determining finish of the drying, or not (S100). If the microcomputer determines that a number of pulses per unit time period counted thus reach to the preset value, recognizing that it is the drying finishing time point, the microcomputer finishes all the drying course (S110).

As described before, not only the small load can be determined by using a number of contact to the drying object at an initial stage of the course, but also a dried state of the drying object, i.e., the dryness, can be determined during the course.

Thus, the present invention determines a load and dryness of the drying object, not by using the direct contact system of the electrode sensor, but by sensing a number of contact to the laundry, and using a number of the contact per unit time period.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

As has been described the dryer and the method for controlling the same of the present invention have the following advantages.

First, a system can be provided in which the load and the dryness can be determined) not by using a direct contact system with the electrode sensor, but by using a number of contact to the laundry. The system permits accurate determination of the load and the dryness, which enables to improve the drying performance.

Second power consumption of the heater can be saved by performing the drying course with an output of the heater varied with the load.

Third, since the provision of a new type of system for determining the load and the dryness enables to provide sensing means of which a power source is separated from a circuit which requires a high voltage, electric shock hazard of the user can be minimized and reliability of the product can be improved.

The invention claimed is:

1. A dryer comprising:

a drum holding laundry to be dried;

a heater supplying hot air to an inside of the drum;

a sensing unit providing a pulse signal depending on contact with the laundry in the drum, the sensing unit including an electrode sensor for providing a voltage signal corresponding to impedance generated at a time the electrode sensor is brought into contact with the laundry; and a microcomputer determining a load size and dryness of the laundry with reference to the pulse signal from the sensing unit, wherein the sensing unit does not generate the pulse signal if the voltage signal from the electrode is higher than a preset reference voltage, and the preset reference voltage is below a voltage level which corresponds to when the laundry is fully dried, and wherein the microcomputer counts a number of pulse signals per unit time period generated by the sensing unit and determines the load size and the dryness according to the counted number.

2. The dryer as claimed in claim 1, wherein the microcomputer controls an output capacity of the heater and a drying course finishing point according to the determined load size and the dryness.

3. The dryer as claimed in claim 1, wherein the heater includes a first heater and a second heater having output capacities different from each other.

4. The dryer as claimed in claim 3, wherein the microcomputer controls operation of the first and second heaters according to the determined load size of the laundry.

5. The dryer as claimed in claim 1, wherein the sensing unit further includes:

a comparator comparing the voltage signal from the electrode sensor with the preset reference voltage, and generating a result of the comparison; and a photo-coupler generating the pulse signal in response to a signal from the comparator.

6. The dryer as claimed in claim 5, wherein the electrode sensor has an output terminal connected to an inverting terminal (−) of the comparator, and a reference voltage thereof is connected to a noninverting terminal (+) of the comparator, and the comparator has an output terminal connected to a light emission unit of the photo-coupler, and a light receiving unit of the photo-coupler connected to an input port of the microcomputer.

7. A method for controlling a dryer having first and second heaters, and a sensing unit for sensing contact of laundry thereto to generate a pulse signal, the sensing unit including an electrode sensor for providing a voltage signal corresponding to impedance generated at a time the electrode sensor is brought into contact with the laundry, comprising:

generating the pulse signal by the sensing unit when wet laundry is brought into contact with the sensing unit;

determining a load size of the laundry with reference to a number of pulse signals generated by the sensing unit before operating the heaters; and determining a dryness of the laundry by counting the number of the pulse signals generated while at least one of the first and second heaters is operated for drying the laundry, wherein the sensing unit does not generate the pulse signal if the voltage signal from the electrode is higher than a preset reference voltage, and the preset reference voltage is below a voltage level which corresponds to when the laundry is fully dried.

8. The method as claimed in claim 7, wherein the determining the dryness of the laundry further comprises:

finishing drying of the laundry if the counted number of the pulse signals per unit time period reaches a preset value.

9. The method as claimed in claim 7, wherein determining the dryness of the laundry further comprises determining a drying finishing time point depending on reaching a preset value of counted pulse signals while the laundry is dried.

10. The method as claimed in claim 7, wherein determining the load of the laundry comprises:

counting the number of pulse signals per unit time period while operation of the heater is stopped for a predetermined time period; and calculating an average number of pulse signals per unit time period if the predetermined time period is passed.

11. The method as claimed in claim 10, wherein determining the load size of the laundry further comprises determining the load size of the laundry as a small load if the average number of pulse signals per unit time is below a preset value.

12. The method as claimed in claim 11, further comprising drying the laundry by controlling an output of the heaters based on the determined load size of the laundry, wherein the drying the laundry comprises operating one of the first and second heaters if the determined load size is a small load.

* * * * *